US007922681B2

(12) United States Patent
Berger et al.

(10) Patent No.: US 7,922,681 B2
(45) **Date of Patent: *Apr. 12, 2011**

(54) PROTECTIVE DEVICE AGAINST FRICTIONAL IRRITATION DUE TO WEARING THONG-TYPE SANDALS AND OTHER FOOTWEAR

(76) Inventors: Sande Berger, New York, NY (US); Leonard Jaffe, Morristown, NJ (US)

( * ) Notice: Subject to any disclaimer, the term of this patent is extended or adjusted under 35 U.S.C. 154(b) by 157 days.

This patent is subject to a terminal disclaimer.

(21) Appl. No.: 12/072,080

(22) Filed: Feb. 22, 2008

(65) Prior Publication Data

US 2008/0208097 A1 Aug. 28, 2008

Related U.S. Application Data

(63) Continuation-in-part of application No. 10/796,265, filed on Mar. 9, 2004, now Pat. No. 7,335,178.

(51) Int. Cl.
*A61F 5/00* (2006.01)
*A11F 13/06* (2006.01)

(52) U.S. Cl. ..... 602/30; 128/893

(58) Field of Classification Search ..... 128/893, 128/894; 602/30, 31
See application file for complete search history.

(56) References Cited

U.S. PATENT DOCUMENTS 2,522,216 A * 9/1950 Ebberts ..... 128/894
2004/0167454 A1* 8/2004 Crunkleton ..... 602/30

* cited by examiner

*Primary Examiner* — Patricia M Bianco
*Assistant Examiner* — Camtu T Nguyen
(74) *Attorney, Agent, or Firm* — William R. Moran

(57) ABSTRACT

A device is provided which gives protection from frictional injury to the web space between toes due to the wearing of thong-type sandals or other similar footwear. The device is comprised of a flat, flexible, medically inert, and preferably transparent plastic material which is can be configured in a variety of shapes and which has a plantar base portion which fits under the toes and on the bottom of the foot, stabilizing the device from moving, a web spacer portion which fits between the toes and provides protection from frictional injury, and a dorsal flap portion which anchors the device to the top side of the foot.

10 Claims, 4 Drawing Sheets

PROTECTIVE DEVICE AGAINST FRICTIONAL IRRITATION DUE TO WEARING THONG-TYPE SANDALS AND OTHER FOOTWEAR

RELATED APPLICATIONS

This application is a continuation-in-part of application Ser. No. 10/796,265, entitled "Protective Device against Frictional Irritation Due To Wearing Thong-type sandals and other Footwear", filed Mar. 9, 2004 by Sande Berger and Leonard Jaffe, now U.S. Pat. No. 7,335,178, which issued on Feb. 22, 2008, the entire contents of which is incorporated herein by reference.

BACKGROUND OF THE INVENTION

1) Field of the Invention

This invention relates to a protective device against frictional irritation of the web space between toes, particularly between the big and adjacent toe, due to the wearing of thong-type sandals or other footwear.

2) Background Art

The problems associated with footwear have become widespread and have advanced the development of shoes over the years from the fashion minded to the functional equipment for the professional and recreational; athlete. These conditions run the gamut of soft tissue injuries to deformity. Obviously cosmetic and function do not always go hand in hand, or in many instances the shoe does not always fit.

One of the oldest form of footwear is a simple sandal with a thong or strap which extends from the top (dosum) to the bottom (plantar) aspect of the foot which act as a tether. The normal linear acceleration in space as one goes through the gait cycle, produces frictional forces and force vectors that result in compression of the first web space or interspace. The constant repetitive trauma results in compression and friction that is painful, irritative, and finally erosion. The simple thong type sandal has in recent years become one of the most common and fashionable types of footwear on the market.

The patent literature discloses a variety of designs for casual footwear including sandals which are available in a wide variety of styles and colors. Regardless of the style or type of sandal, many have a thong or strap between the toes, which aids in anchoring the sandal to the wearer's foot.

Many years ago in 1915, U.S. Pat. No. 1,129,670, issued and disclosed a foot-toe cushion and shield which was comprised of a transverse arch or ridge arranged to fit under the adjacent sole of the foot and to support the toes with blades projecting longitudinally from the arch or ridge and arranged to fit between the toes. The cushion and shield were designed to be worn within stockings for the purpose of overcoming deformities of the toes, arresting the tendency to malformation of the toes and other foot troubles of like nature.

Years later in 1950, U.S. Pat. No. 2,506,308, issued and disclosed a toe-separating device. The central portion of each separator is concave in shape, so that when viewed, appears to have an hour glass shape. The purpose of such shape is to conform to the general shape of the sides of the toes. The device as disclosed in the patent, can be formed of a highly porous, spongy material such as soft rubber which can deform to a large degree by a relatively light pressure.

In U.S. Pat. No. 4,207,880, there is disclosed and claimed a toe separator and pedicure aid which utilizes both a corrective aid for separating overlapping or crooked toes and as a pedicure aid to keep toes separated during pedicures, polish or medicine application. The toe separator apparatus is comprised of a pliable and substantially non-elastic sole member which extends substantially to the width of the users foot and has a plurality of slits formed near the toe end and a plurality of separate elements fastened to the sole member.

A more recent U.S. Pat. No. 4,769,013, which issued Sep. 6, 1988, discloses and claims a bio-effective material and device for treating athlete's foot. Even though the wearing of sandals allows the feet to be exposed to the air, fungal infections are common and require appropriate treatment. The reference invention discloses and claims a medical material having an anti-fungal activity and is comprised of a polyurethane complexed with polyvinypyrollidone and an anti-bacterial agent complexed with polyvinylpyrollidone.

U.S. Pat. No. 2,595,640 which issued on May 6, 1952, discloses and claims a toe spacer device for maintaining the toes of a foot in separate relationship and is comprised of a plurality of wedge-shape members adapted to be inserted between the toes while the toes are manicured.

1 Apr. 1956, U.S. Pat. No. 2,740,207, issued and disclosed certain medicated shoes having a vamp with a completely open toe section and an inner sole for the treatment of athletes foot. It is indicated at column 1, lines 20 et seq. that the invention is concerned with irritation around the toes and the skin between and under the toes. The medicated shoe or slipper is comprised of a plurality of soft yielding partitioning strips, substantially narrower than the length of toe space in the slipper and is secured to one end of the inner sole and at the other end to the inside of the vamp in the region of the junction of the toe and foot. The stripes have medication for treatment of the foot.

U.S. Pat. No. 5,906,007, which issued May 25, 1999, discloses an article of footwear for use in relation to a pedicure. The article has a body portion which is worn like a stocking and a top portion covering each toe.

IN May, 2001, U.S. Pat. No. 6,226,893B1 issued and discloses a pedicure sandal having a plurality of toe-receiving loops for engaging the wearer's toes. It is indicated in the patent that during the performance of a pedicure, it is necessary to maintain the toes of the pedicure recipient in spaced apart relation to provide easy access by the person performing the pedicure.

Prior to the present invention, simple and comfortable devices were not available for minimizing the potential irritation between the big and adjacent toe due to the presence of the thong of sandals and similar footwear. Accordingly, these and other objects will readily become apparent in like of the teachings herein set forth.

It is an object of this invention to provide a device or web space protector for thong-type sandals and other footwear. Another object of this invention is to provide a web space protector which is easily installed when wearing sandals and protects the skin between the large toe and the adjacent toe from unnecessary irritation by the thong. A still further object is to provide protection for the web space between toes which is easy to apply and is essentially invisible to the wearer. Another object of this invention is to provide a device or web space protector which adheres to the skin of the foot without the need for an adhesive and is comprised of a material which already had application in a wide variety of medical applications. These and other objects will readily become apparent to those skilled in the art to which this invention pertains.

SUMMARY OF THE INVENTION

In its broad aspect, the present invention is directed to a protection device against the irritation of the web space between the big toe and adjacent toe, or other adjacent toes, due to the wearing of thong-type sandals or other footwear. The device is flat and flexible in shape and comprised of, in combination;

(a) a first portion which is a plantar base zone that extends medially and laterally and has a distal portion extending towards the acral or tip portion of the toes. This plantar base zone conforms to the base of the metatarsal phalageal joint, to stabilize and prevent dorsal migration of said device;

(b) a second zone which is a dorsal flap extending over the dorsal area of the foot; and (c) a web spacer zone between and of a lesser width than said planter base and dorsal flap and which zone can fold vertically so that each side touches adjacent toes.

DESCRIPTION OF THE PREFFERED EMBODIMENTS

Figure 1:
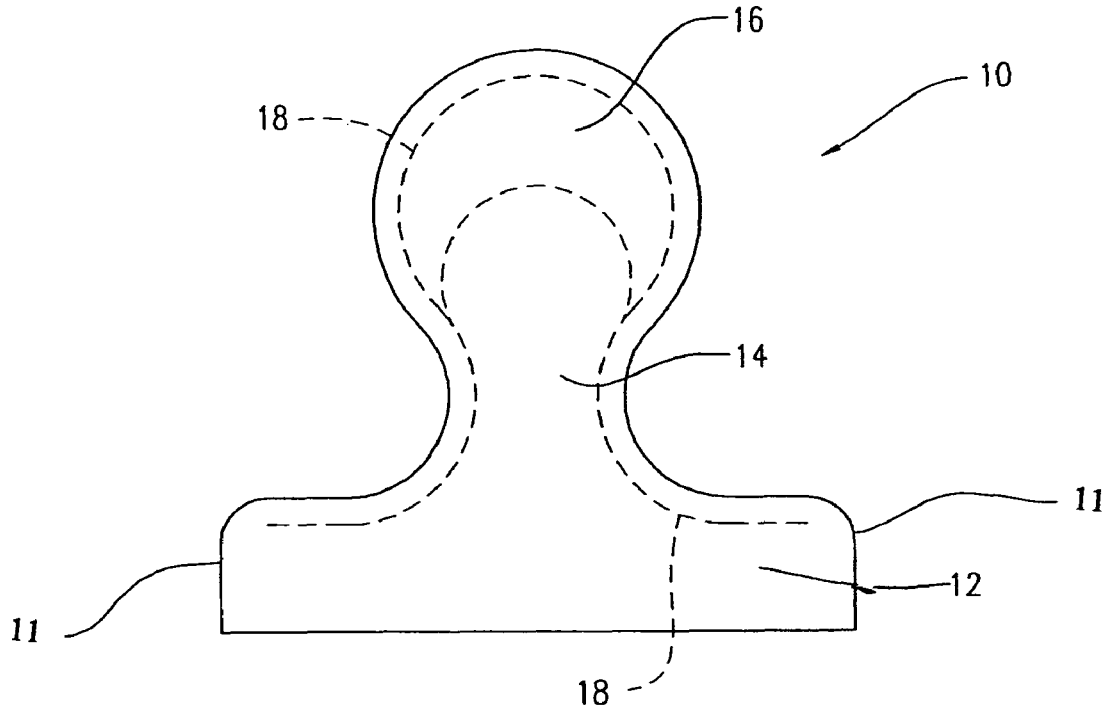
FIG. 1 is a top view of the device of the present invention and depicts the plantar base, web spacer and dorsal flap together with indicia along which the device can be cut to proper size.

The invention will be more readily understood by reference to the drawings wherein:

FIG. 1 depicts the top view of device 10 which essentially has a head and shoulder shape and is comprised of a planter base 11 and 12, web spacer 14, and dorsal flap 16. The device is comprised of an inert material, as hereinafter described, which is flat, flexible inert and which has a frictional coefficient such that it is retained on the skin without the need for an adhesive. Also depicted in FIG. 1 are markings or indicia 18 along which the user can cut the material to conform the shape of the device for ones individual needs.

Figure 2:
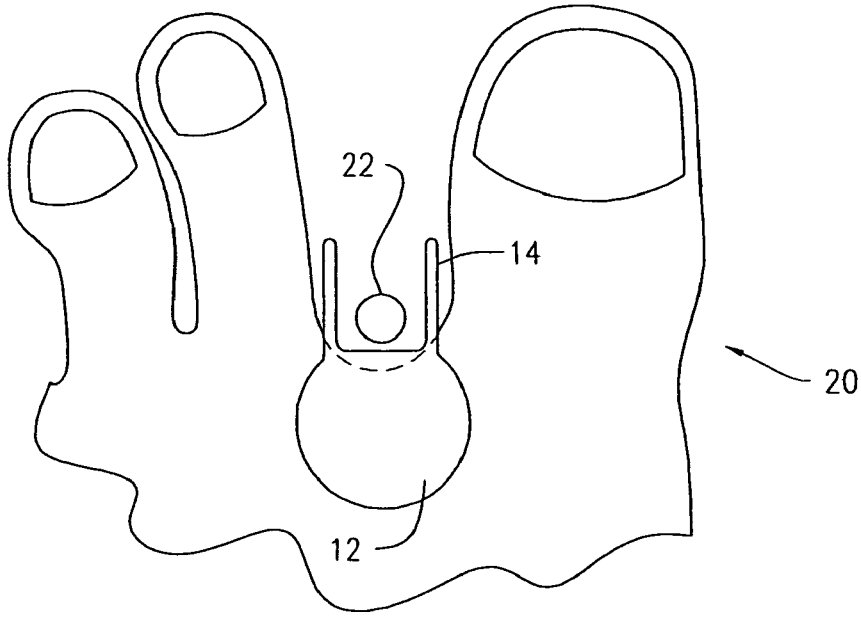
FIG. 2 is a partial top view of a foot showing the dorsal flap of the device and the folded web spacer.

FIG. 2 depicts the top view of a portion of a person's foot 20 showing the dorsal flap 16 and web spacer 14 folder over so that it protects the web skin from irritation due to a thong or other strap 22.

Figure 3:
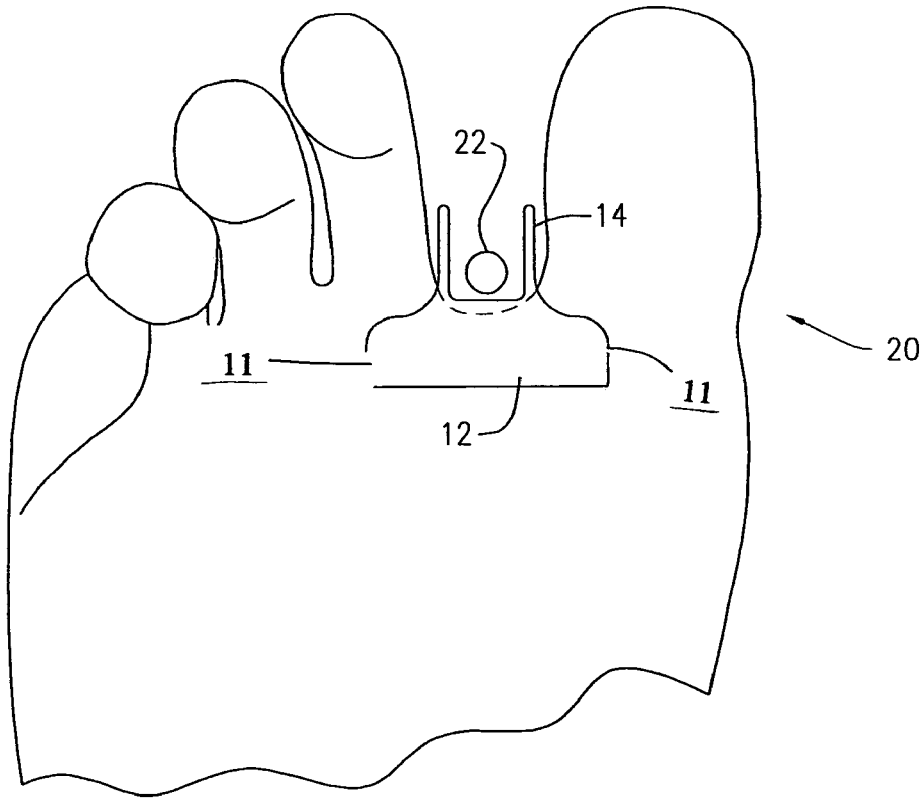
FIG. 3 is a partial bottom view of a foot showing the plantar base and the folded web spacer.

FIG. 3 depicts the bottom side of the portion of a foot 20 showing the plantar base 12 which stabilizes the device from migration. Also shown are the folded web spacer 14 and thong or step 22.

Figure 4:
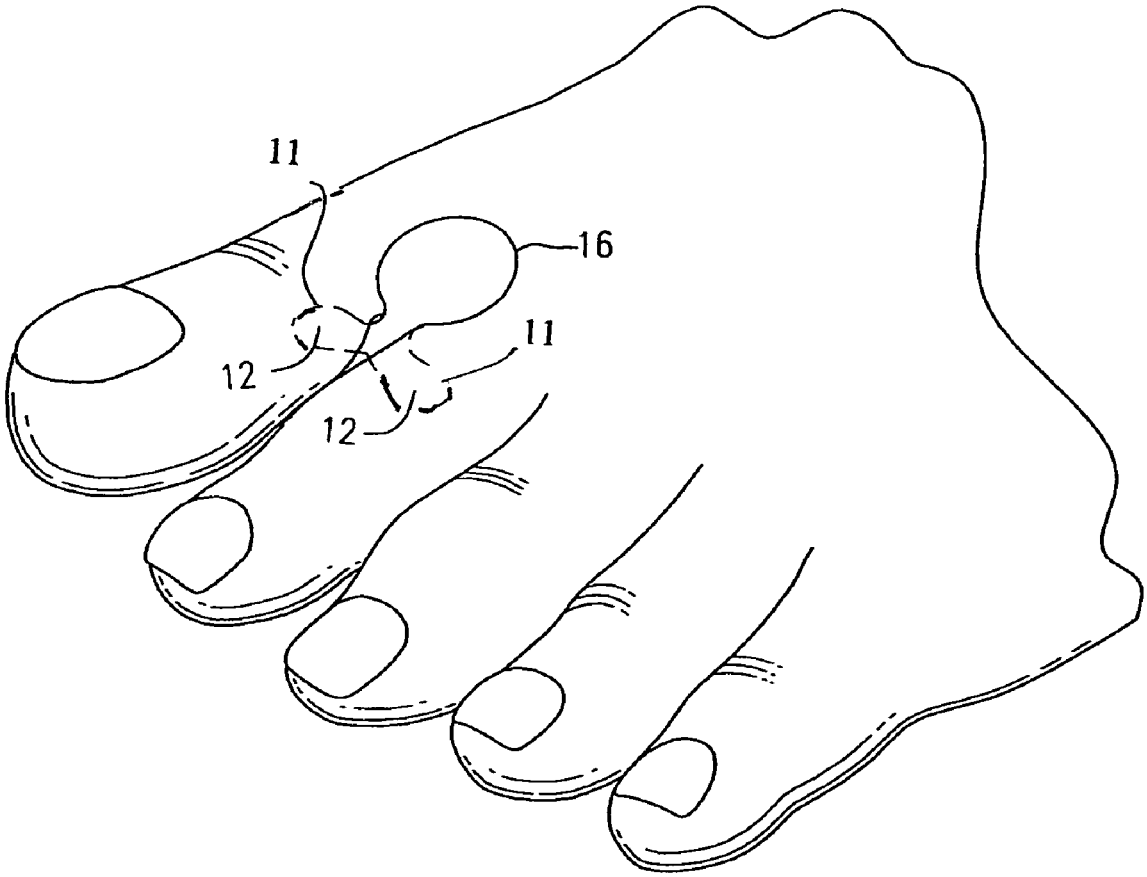
FIG. 4 is partial plan view of the top side of the foot with the device of the invention.
Figure 5A:
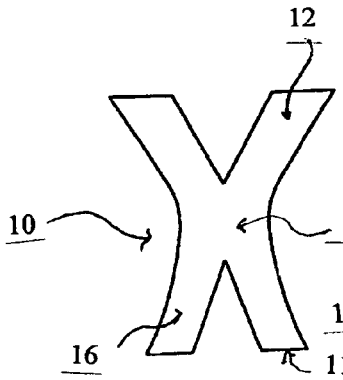
FIG. 5 is a top view of various other possible configurations of the device of the present invention in addition to the configuration shown in FIG. 1.
Figure 5B:
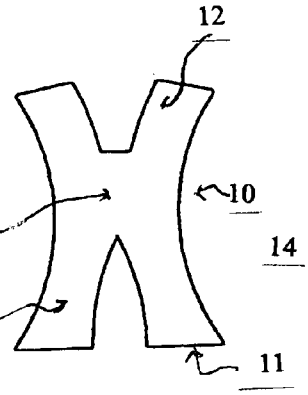
Figure 5C:
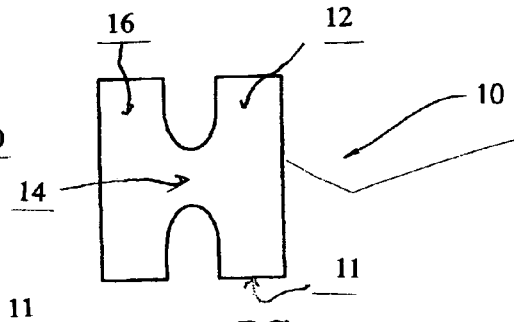
Figure 5D:
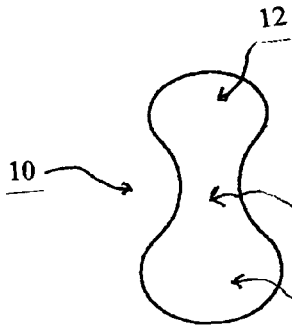
Figure 5E:
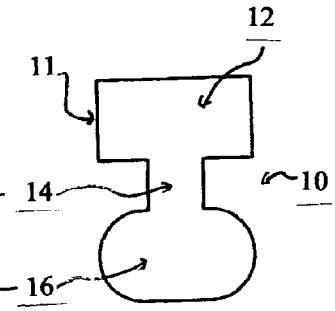
Figure 5F:
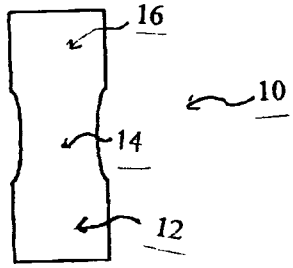

FIG. 4 is a plan view of a person's foot showing how the device fits into the space between the large and adjacent toes. Dorsal flap 16 is shown on the top portion of the foot and the dotted lines indicate how the plantar base 12 attaches to the bottom of the foot.

FIG. 5 depicts top views of other possible configurations of the device which can be essentially in the shape of an X, an H, an hour glass, or even the upside down version of FIG. 1. Other configurations than those shown in FIG. 5 are possible if within the broad scope of this invention.

The device of the present invention can be fabricated from a wide variety of materials, the only requirement being that the material be flexible, inert to the skin, and possess the ability to adhere to the skin without the need for adhesives of any kind. In particular, it has been As indicated above, the material employed in the device of the present invention are flexible, and in sheet form as well as being inert to the skin. Hence, the material should be selected from among those which themselves which will not irritate the body.

Since there is a wide variety in the size of a person's foot and toes, the device of this invention can be fabricated in many different sizes. For the average adult the device can range from about 1.5 to about 3.0 inches in length from top to bottom, and a width at the dorsal area of from about 1.5 to about 3.0 inches and at the flap area, a width of from about 0.5 to about 1.0 inches. A preferred device is one having a length and width of from about 2.0 inches and a width of from about 0.5 to about 1.0 inches. Depending upon the individual, larger dimensions can be equally as well be used if desired.

The thickness of the plastic material employed is not critical but, of course, should be sufficient to protect the web space of the wearer from irritation and sufficient as not to be worn out by the thong strap during the period that the device is worn. The thickness must also be such that the material remains flexible and adheres to the skin without the employment of adhesives. Thus, in practice it has been found that the thickness of the material can vary from about 0.015 to about 0.020 mm. The particular chemical composition of the material may influence the thickness of the film or sheet so that it remains flexible.

In practice, it has been found that a variety of materials in the form of films or sheets which are currently used in the medical profession are highly suitable for use in the present invention. Many of these material are in sterile form and readily accepted for use inside as well as outside the body. These material already come in the proper thickness and flexibility and transparency which is an added feature. Hence the device of this invention can utilize both surgical and nonsurgical viscoelastic materials and combinations of silastic as well as those composed of a gel interposed between layers of silastic. It has also been found that a variety of other materials may also be useful For example, materials such as organic polymers and copolymers can be employed. Such materials include, but are not limited to, polymers and copolymers comprised of in polymerized form, ethylene, propylene, butylenes alone or copolymerized with other monomers. For instance, the polymers disclosed in U.S. Pat. No. 4,769,013 may be used.

Illustrative of the types of materials that can be used include many polymers and copolymers of sufficient molecular weight to form inert, flexible sheets or films of the desired thickness. Several films that are used in the medical profession are particularly desirable since they are sterile, flexible, transparent or opaque and have the physical properties which are desired for the device of this invention.

Particularly preferred materials are the duralastic sheeting used for short term implantation sold by Allied biomedical of 3850 Ramada Drive, Paso Robles, Calif. 93446. and a silicone sheeting marketed by Xomed of Jacksonville, Fla. 32216.

As indicated in the drawings, and in view of the differences in the size of a person's foot and toes, the device as marketed can be trimmed at the different markings on the device to obtain the proper size for any particular individual. The materials used can easily be cut to size with a pair of scissors.

The present invention accordingly provides a device that protects the web space and provides a comfortable means for cushioning and protecting the skin and deeper structures from compression and frictional injury. The device is well tolerated and cosmetically acceptable. It is used both prophylactically as well as means to protect an already injured area. The device not only resists compression but is adaptable with a stress relief pad or a special application of topical medicines.

Although the invention has been illustrated by the preceding examples, it is not to be construed that the invention is limited to the materials disclosed therein, rather, the invention is directed to the generic area as a whole. Various modifications and embodiments can be made without departing from the spirit or scope thereof.

What is claimed is:

1. A protective device against irritation of the web space between the big toe and adjacent toe due to the wearing of thong-type sandals, said device is a flat, flexible sheet having a thickness of from about 0.015 to about 0.020 mm, said device comprised of, in combination, (a) a planer base zone that extends medially and laterally and has a portion thereof extending towards the acral or tip portion of the toes, said portion conforming to the base of the metatarsal phalageal joint to stabilize and prevent dorsal migration of said device;

(b) a second zone which is a dorsal flap extending over the dorsal area of the foot, (c) and a web spacer zone between and of lesser width than said plantar base zone and the dorsal flap zone, and which web spacer can fold along a vertical axis so that each side of the web spacer touches adjacent toes, said sheet comprised of an inert plastic material having frictional coefficient properties which enhance its adhering to the foot skin of a human without need for adhesives.

2. The device of claim 1 wherein the plastic material is a surgical or nonsurgical viscoelastic material.

3. The device of claim 1 wherein the dorsal flap is essentially semi-circular in shape.

4. The device of claim 1 wherein the plantar base has wings extending in opposite directions to stabilize and prevent migration.

5. The device of claim 1 wherein the plastic material is sterile.

6. The device of claim 1 which is in the shape of an X.

7. The device of claim 1 which is essentially in the shape of an H.

8. The device of claim 1 which is essentially in the shape of an hour glass.

9. The device of claim 1 wherein the plastic material is transparent.

10. The device of claim 1 wherein the plastic material is flesh color.

* * * * *